US007861916B2

(12) United States Patent
Little

(10) Patent No.: US 7,861,916 B2
(45) Date of Patent: Jan. 4, 2011

(54) MATERIALS FOR AND METHOD FOR MANUFACTURING CONTAINER WITH INTEGRATED DIVIDER AND RESULTING CONTAINER

(75) Inventor: Troy Little, Thomasville, PA (US)

(73) Assignee: York Container Company, York, PA (US)

( * ) Notice: Subject to any disclaimer, the term of this patent is extended or adjusted under 35 U.S.C. 154(b) by 90 days.

(21) Appl. No.: 12/246,589

(22) Filed: Oct. 7, 2008

(65) Prior Publication Data

US 2010/0084459 A1 Apr. 8, 2010

(51) Int. Cl.
*B65D 25/04* (2006.01)
*B65D 5/492* (2006.01)
*B65D 5/493* (2006.01)

(52) U.S. Cl. ..... 229/120.26; 229/120.24; 229/120.29; 229/120.34; 229/164

(58) Field of Classification Search ..... 229/120.24, 229/120.26, 120.29, 120.33, 120.34, 120.37, 229/120.38, 164, 918; 206/427
See application file for complete search history.

(56) References Cited

U.S. PATENT DOCUMENTS 2,894,672 A 7/1959 Bamburg
2,939,620 A 6/1960 Royce
3,034,698 A 5/1962 Forrer
3,048,318 A * 8/1962 Sabin ..... 229/120.38
3,236,433 A * 2/1966 Barrett et al. ..... 229/120.28
3,373,921 A 3/1968 Crane
3,397,831 A 8/1968 Adams
3,696,990 A 10/1972 Dewhurst
3,912,159 A * 10/1975 Danville ..... 229/120.26
3,982,684 A * 9/1976 David ..... 229/120.26
4,056,223 A 11/1977 Williams
4,058,249 A 11/1977 Buck
4,068,796 A 1/1978 Kullman, Jr.
4,197,980 A 4/1980 Johnson
4,403,729 A 9/1983 Wytko
4,605,158 A * 8/1986 Barton ..... 229/120.23
4,874,125 A 10/1989 Bates
5,294,044 A 3/1994 Clark
5,350,109 A 9/1994 Brown et al.
5,375,715 A 12/1994 Serre et al.
5,400,955 A 3/1995 Coalier et al.
5,415,345 A 5/1995 MacKinnon
5,505,368 A 4/1996 Kanter et al.
5,520,325 A * 5/1996 Quaintance ..... 229/120.26
5,673,848 A 10/1997 Garza
5,791,555 A 8/1998 Kanter
5,853,120 A 12/1998 McLeod
5,947,292 A 9/1999 Chelfi
5,975,413 A 11/1999 Moen
5,979,746 A 11/1999 McLeod et al.
6,015,084 A 1/2000 Mathieu et al.
6,085,969 A 7/2000 Burgoyne
6,158,653 A 12/2000 Kanter et al.
6,270,007 B1 8/2001 Jensen, Jr.
6,325,282 B1 12/2001 Kanter et al.
6,513,705 B1 * 2/2003 Sheffer ..... 229/164

(Continued)

*Primary Examiner*—Gary E Elkins
(74) *Attorney, Agent, or Firm*—Barnes & Thornburg LLP

(57) ABSTRACT

In accordance with the invention, a method of manufacturing containers such as shipping, display and display ready packaging, for example, and resulting containers and associated preassemblies and blanks are provided, which, when utilized, result in preassemblies that are more easily, reliably and quickly assembled into fully assembled containers.

25 Claims, 7 Drawing Sheets

U.S. PATENT DOCUMENTS 6,712,214 B1 3/2004 Wintermute et al.
6,817,514 B2 11/2004 Kanter et al.
6,874,679 B2 4/2005 Tibbles et al.
6,962,558 B2 11/2005 Dalrymple
7,066,379 B2 * 6/2006 McLeod et al. ..... 229/120.26
7,290,696 B2 11/2007 McClure
2003/0146130 A1 8/2003 Kanter et al.
2005/0161496 A1 * 7/2005 McLeod et al. ..... 229/120.26
2005/0242164 A1 11/2005 Teixidor Casanovas
2007/0108261 A1 5/2007 Schuster

* cited by examiner

MATERIALS FOR AND METHOD FOR MANUFACTURING CONTAINER WITH INTEGRATED DIVIDER AND RESULTING CONTAINER

The invention relates in general to the manufacture of containers that may be readily used to ship and/or display contents following delivery of the container, as specified in the independent claims.

BACKGROUND OF THE INVENTION

Various containers are conventionally provided as packaging for shipping or for display of product in a retail environment to prospective customers. As is conventionally known in the industry, such containers can be transported to manufacturing and/or retail environments for use in shipping or display in knock-down form; i.e., flattened but otherwise being glued, stapled or otherwise secured together, such that they are already substantially pre-assembled; such knock-down form containers are also referred to as preassemblies. In such a "knockdown" state (i.e., knocked down or not set-up), personnel assembling the product container need only open the sides and or ends of the container and affix the package bottom wall into its assembled condition. As a result, such containers assembly may be performed such that the product can be placed into a resulting assembled container for shipping or as display package for ready display.

Conventionally, it has been deemed advantageous at times to stack a plurality of such containers, one on top of the other for the purposes of transport to a retail environment or during display in the retail environment. In this use, it is necessary that the containers stacked above the bottom-most package are amply supported also that a stack of a number of such containers, when filled with product, will not collapse.

However, the time required for assembling containers such as display cases can be somewhat lengthy as assembly of a container may require a number of separate actions to be performed by the assembler. The number of such separate actions is conventionally referred to as the number of "touches" required for assembly; thus, a container requiring complex assembly requires a greater number of touches than a container requiring relatively simple assembly. Moreover, because assembly may be performed by one or more personnel members, the quality of an assembled container may be variable based one personnel skill and expertise.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to the more detailed description below.

In accordance with illustrated embodiments, a method is provided of manufacturing containers and resulting containers and associated preassemblies and blanks, which, when utilized, result in containers that include a supplementary blank that provides a plurality of pillars that serve as a mechanism for dividing the container into a plurality of compartments and as a mechanism for increasing stacking strength of the container, whereby the container may be configured to bare larger amounts of weight than without the supplementary blank without collapse.

Additionally, illustrated embodiments may provide consistent assembly of divided containers for shipping, display and/or display ready packaging including a plurality of compartments, wherein the compartments are formed by the interaction of the supplementary blank with a primary blank through at least one of adhering a plurality of parts of the supplementary and primary blanks to one another and the interaction between supplementary corner tabs of the supplementary blank and the corners of the tray formed by the primary blank.

These illustrated embodiments are achieved by a combination of features recited in the independent claim. Accordingly, dependent claims prescribe further detailed implementations of the present invention.

BRIEF DESCRIPTION OF THE DRAWINGS

Various embodiments are described herein, by way of example only, with reference to the accompanying drawings. With specific reference now to the drawings, it should be understood that the particulars shown are by way of example and for purposes of discussion of illustrated embodiments only, and are presented in order to provide what is believed to be a useful and readily understood description of the principles and concepts of the invention. In this regard, no attempt is made to show structural details of the invention in more detail than is necessary for a fundamental understanding of the invention, the description taken with the drawings making apparent to those skilled in the art how the several forms of the invention may be embodied in practice.

Accordingly, a more complete understanding of the present invention and the utility thereof may be acquired by referring to the following description in consideration of the accompanying drawings, in which like reference numbers indicate like features, and wherein.

DETAILED DESCRIPTION OF THE INVENTION

In the following description of various invention embodiments, reference is made to the accompanying drawings, which form a part hereof, and in which is shown, by way of illustration, various embodiments in which the invention may be practiced. It is to be understood that other embodiments may be utilized and structural and functional modifications may be made without departing from the scope and spirit of the present invention.

Although knockdown display containers (i.e., a preassembly) provide the opportunity for product manufacturers and retailers to present product in a customized manner, the time and skill required for assembling such containers in a consistent manner varies depending on the number of "touches" required for assembling the container. That is, the more complicated the container, the more time it takes to assemble it. Additionally, the more complicated the container, the more likely the container is to be assembled in a manner that provides inconsistent resulting containers, i.e., containers do not look the same.

Therefore, although the use of containers that may be used for display can improve sales of product in a retail environment and the user of containers that have increased features (e.g., pillars that enable increased stacking strength) both can improve the retailer's ability to use retail space efficiently, the fulfillment cost and time to assemble the container detracts from the provided utility. Thus, there is a need to reduce the number of touches required for final assembly of a container, for example, a shipping package, display or display ready package or compartmentalized package so as to reduce fulfillment cost and time. Additionally, there is a need to increase the consistency with which such containers may be assembled so as to generate more consistent containers without regard to the skill or experience level of an assembler.

With this understanding in mind, a description of various invention embodiments is now provided.

Figure 1:
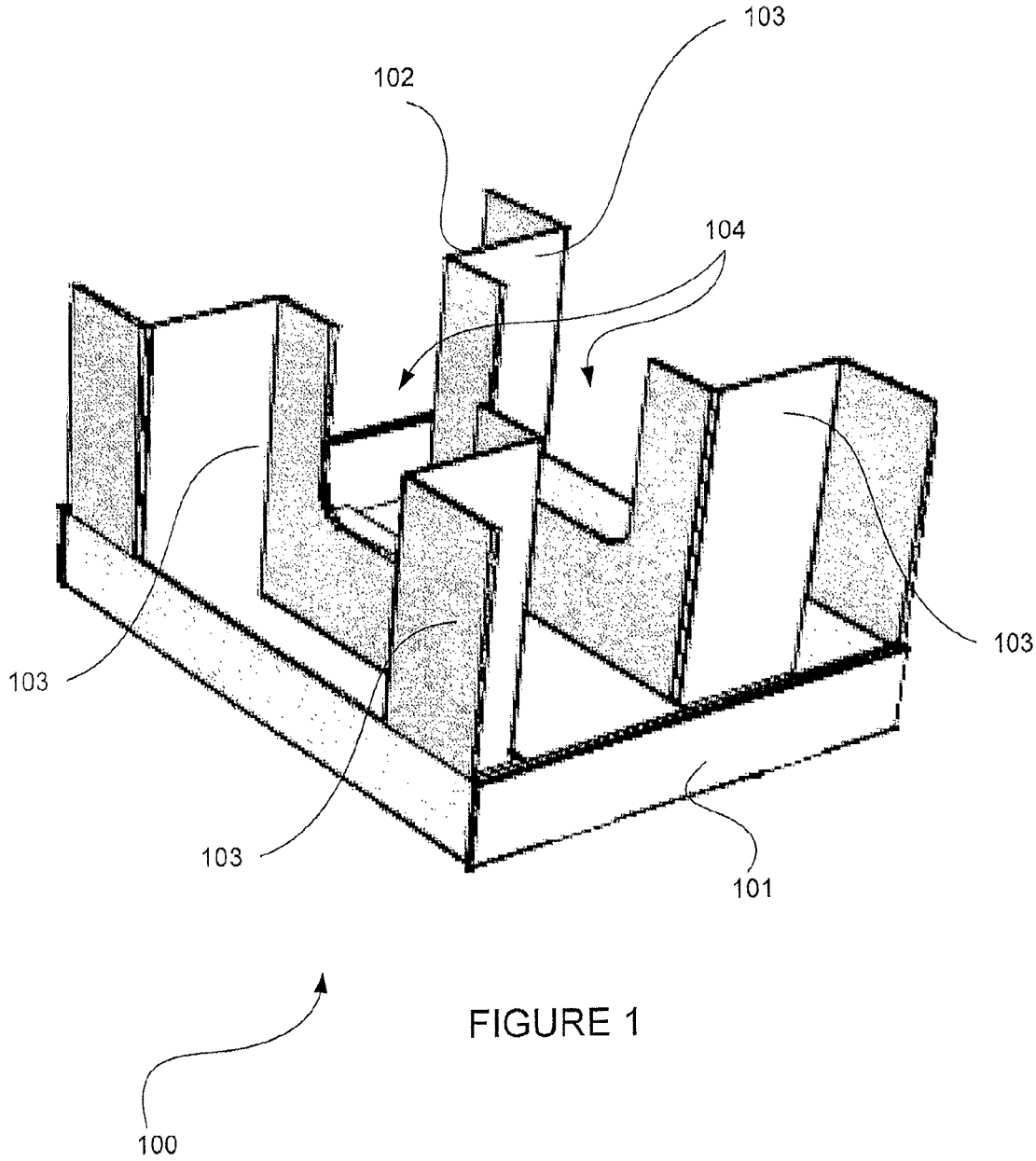
FIG. 1 illustrates a side perspective view of a container manufactured in accordance with an illustrated embodiment.

Understanding of the manufacturing of a container, blanks and/or preassemblies in accordance with embodiments may best be understood by first reviewing an illustration of a manufactured container provided in accordance with one illustrated embodiment. As illustrated in FIG. 1, one example of such a container 100 may include a plurality of compartments defined between a plurality of pillars 103 formed by a supplementary blank 102 and included in an interior space of a primary blank following assembly. These pillars 103 may optionally be coupled to one another such that an opening 104 is provided between pairs of adjacent first and second pillars 103 and may be utilized as part of a display configuration if the container 100 is used in a display function. For example, such a container 100 may be used for various display purposes including placement on a display floor along with other such containers in a stack. However, it should be understood that the manufactured container may be any type of container including, for example, any carton, package, box, etc. of any suitable type; accordingly, the actual configurations of the primary blank 101 may and the interrelationship with the supplementary blank 102 may change without departing from the scope of the embodiments.

Thus, in accordance with illustrated embodiments, a method is provided of manufacturing containers and resulting containers 100 and associated preassemblies (the combination of 101, 102) and blanks 101, 102, which, when utilized, result in containers 100 that include a supplementary blank 102 that provides a plurality of pillars 103 that serve as a mechanism for dividing the container into a plurality of compartments. These pillars 103 also increase the stacking strength of the container 100, whereby the container 100 may be configured to bare larger amounts of force (e.g., weight) from a top direction than without the supplementary blank.

As will be appreciated from the remaining disclosure by one of ordinary skill in the art, the container 100 may be used to display product therein in a retail environment. Thus, subsequent to arrival at a retail environment or off-site fulfillment or contract packaging facility, a knockdown version of the container 100 (e.g., a preassembly) may be assembled and product placed in the container 100 for transport and/or display.

Figure 2:
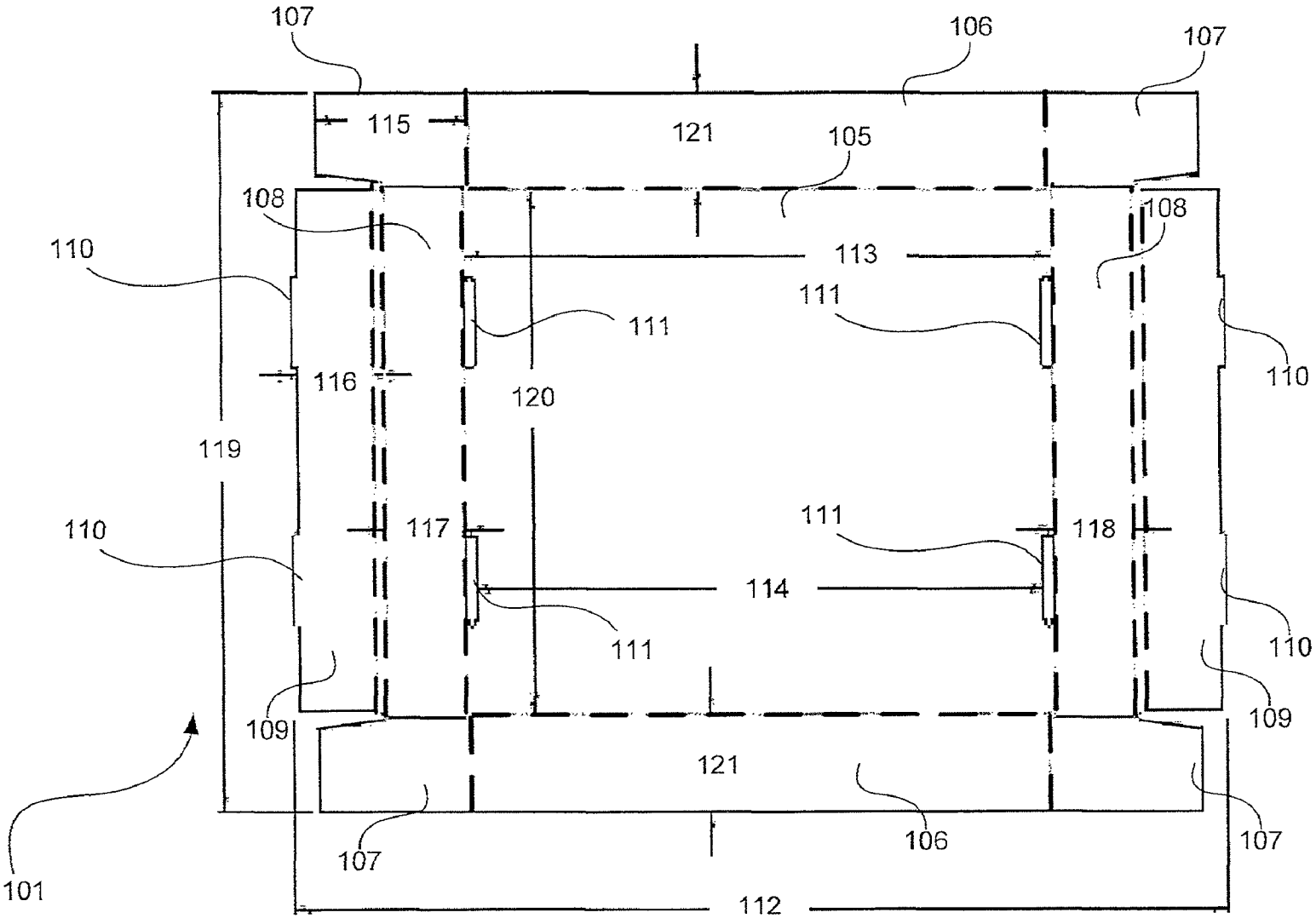
FIG. 2 illustrates an example of a primary blank used in manufacturing the container of the type illustrated in FIG. 1.

FIG. 2 illustrates an example of a primary blank 101 which may be thought of as a conventional tray such as the one illustrated in FIG. 1. The knockdown of the container 100 is manufactured by joining the primary blank 101 with a supplementary blank 102 (which may be thought of as a pad) illustrated in FIG. 3, as explained herein. The blank 101 illustrated in FIG. 2 corresponds to an exterior of the container 100 illustrated in FIGS. 1 and 4; therefore, the container 100 includes primary blank 101. Likewise, the container 100 also includes supplementary blank 102 illustrated separately in FIG. 3 and in conjunction with primary blank 101 in FIG. 4.

As used in FIG. 2, solid lines indicate edges of the blank illustrated, whereas dashed lines indicate perforation, folding or scoring lines provided as part of manufacturing to enable folding of the blanks along the dashed lines.

As shown in FIG. 2, the primary blank 101 includes a major panel 105 surrounded by two side panels 106 and two end panels 108. Corner tabs 107 are attached to the side panels and are contained in a slot formed when an end panel 108 is folded up and a corresponding end flap 109 is folded towards the end panel 108 and the end tabs 110 engage with the end slots 111. The interaction of an end panel 108 and end flap 109 during final assembly of the container 100 may be thought of or referred to as a "rollover" of the primary blank. For convenience, the same reference numerals are used to denote the walls of the container 100 and the panels of the primary blank 101.

Thus, the total length 112 of the blank 101 includes the length 114 of the major panel 105 as well as the lengths 117 of the two end panels 108 and the lengths 116 of the end flaps 109 (which are illustrated as greater than the lengths 115 of the corner tab 107 but are not necessarily so). Likewise, the total width 119 of the blank 101 includes the width 120 of the major panel 105 as well as the widths 121 of the two side panels 106.

Figure 3:
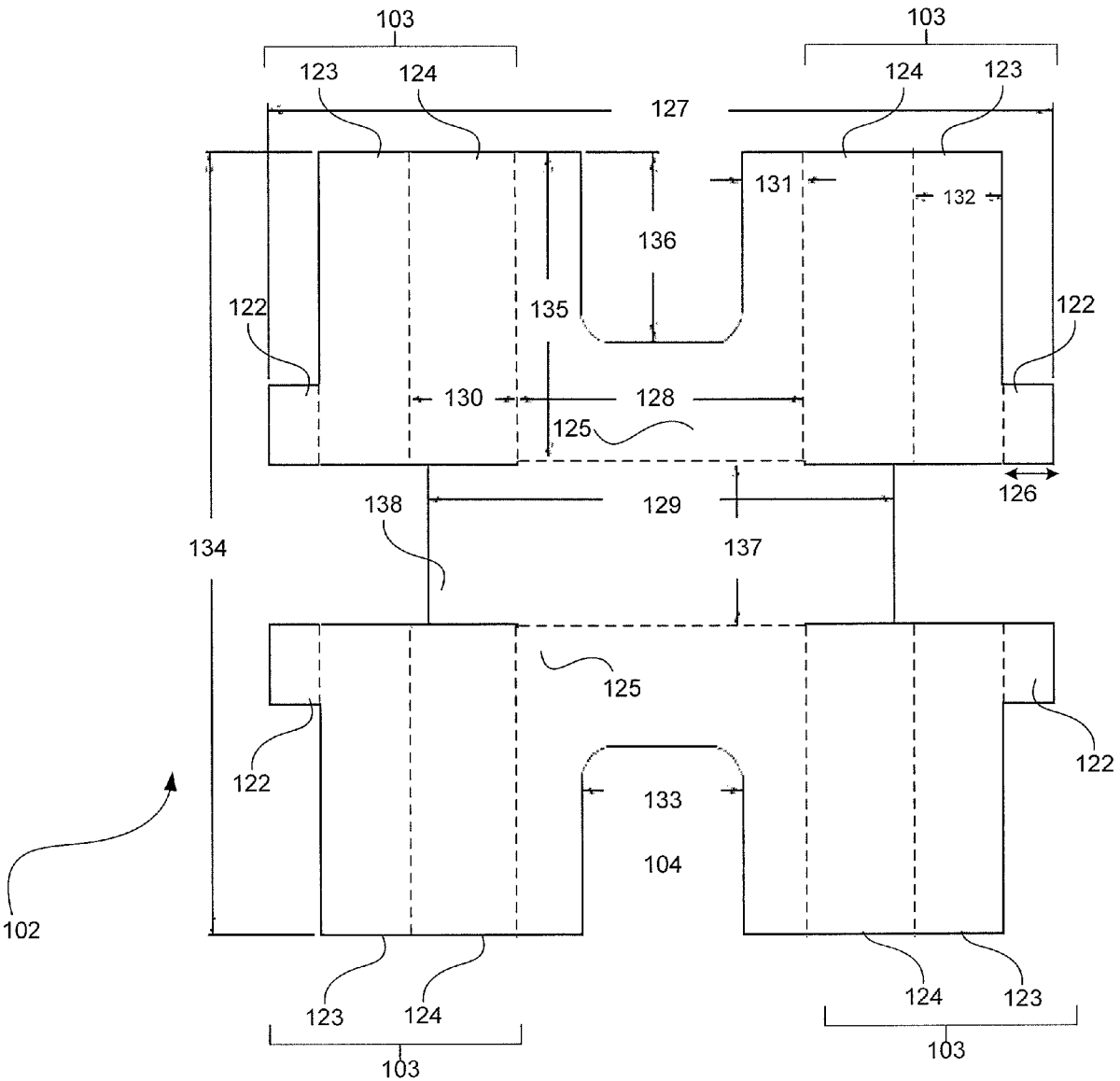
FIG. 3 illustrates an example of a supplementary blank used in manufacturing the container of the type illustrated in FIG. 1.

FIG. 3 illustrates an example of a supplementary blank 102 used in manufacturing the container of the type illustrated in FIG. 1. The supplementary blank 102 includes a plurality of supplementary corner tabs 122 hindgedly attached to first pillar section 123, which together with second pillar section 124 comprise a pillar 103 (as illustrated in FIG. 1). The pairs of adjacent pillars 103 are coupled in one direction together via main divider walls 125, which may optionally include apertures 104. Such apertures 104 may be provided to enable access to product stored in the container or be provided as a mechanism to provide stability between two adjacent pillars 103 while reducing an amount of material needed to effect the container 100. The pairs of adjacent pillars 103 are coupled together at a right angle direction via a primary panel 138 that, when the container is fully assembled will be in contact with (and optionally affixed to) the major panel 105.

The total length 127 of the supplementary blank 102 includes the length 129 of the primary panel 138 which is illustrated (but need not be) greater than the length of the main divider walls 125 (comprised of the length of the aperture 133 and associated side sections 131 of the main divider wall 125) as well as the widths 132, 130 of the first and second pillar sections 123, 124 as well as the length 126 of the supplementary corner tabs 122. Likewise, the total width 134 of the blank 102 includes the width 135 of the main wall divider 125 (which included the width 136 of the aperture 104).

As explained above, illustrated embodiments may provide consistent assembly of divided containers for shipping and/or display ready packaging including a plurality of compartments, wherein the compartments are formed by the interaction of the supplementary blank 102 with the primary blank 101 through at least one of adhering a plurality of parts of the supplementary and primary blanks to one another and the interaction between supplementary corner tabs of the supplementary blank and the corners of the tray formed by the primary blank.

Figure 4:
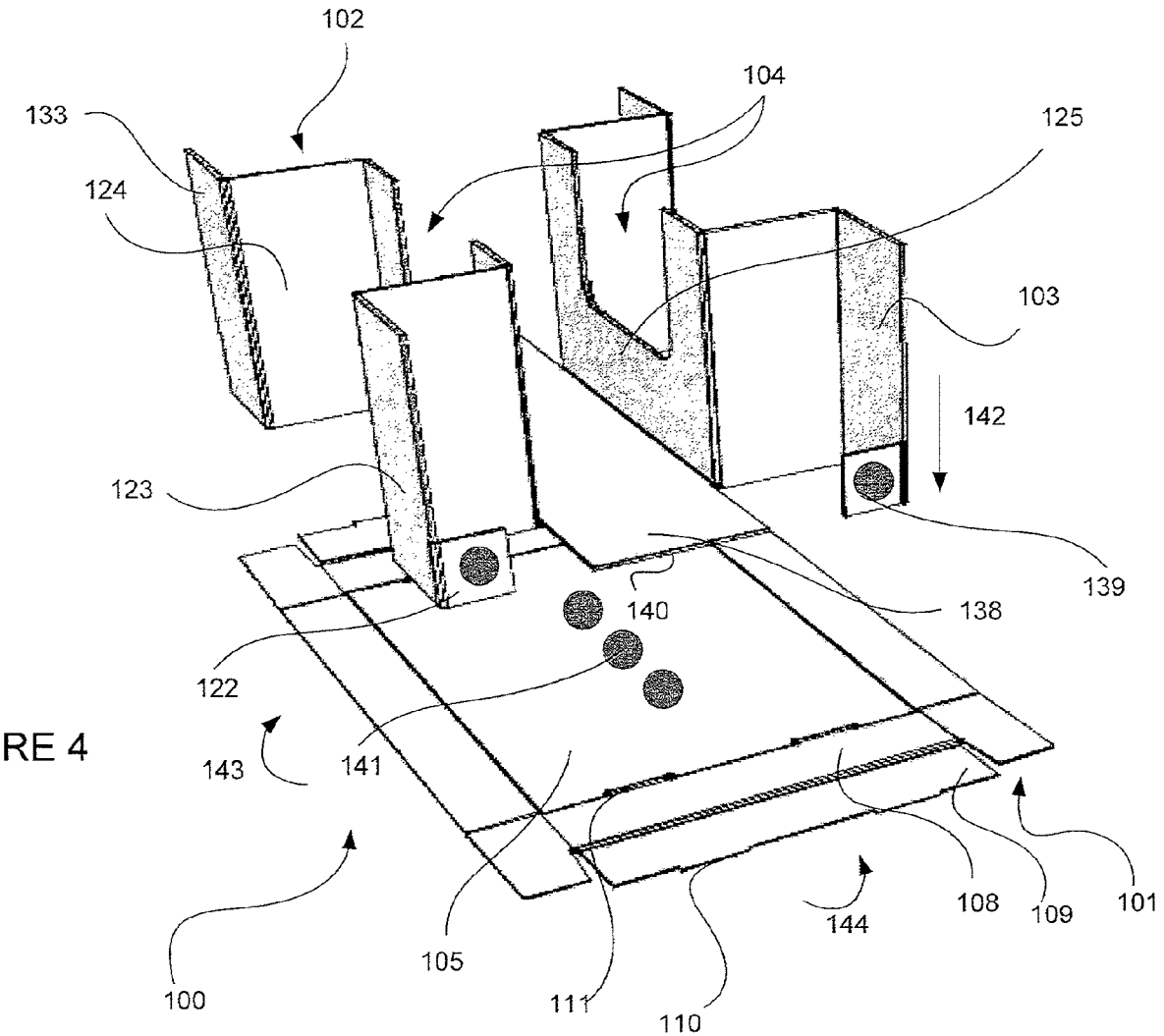
FIG. 4 provides an exploded view of the container illustrated in FIG. 1 and illustrates the interconnectedness of the primary and supplementary blanks illustrated in FIGS. 2 and 3 to provide the container illustrated in FIG. 1.

Accordingly, as illustrated in FIG. 4, the primary and supplementary blanks 101, 102 may be configured so as to interact in a manner that enables the pillars 103 to act as both weight bearing mechanisms and dividers. Accordingly, the total length and width dimensions for the blanks 101, 102 and their constituent panels, walls and sections may be selected so as to facilitate the positioning of the blank 102 within the interior of the assembled blank 101. Furthermore, as illustrated, the lengths may be selected so that the supplementary corner tabs 122 are positioned to either abut the corners formed by the end panel 108 and side panel 106 or be inserted into the rollover of the primary blank (i.e., the slot formed by the end panel 108 and end flap 109) along with the corner tab 107.

It should be appreciated that, although FIG. 4, and other figures illustrate specific configurations for lock slots and tabs, the inventive concept applies to various different configurations both known and not yet developed in the container manufacturing industry. Accordingly, one of ordinary skill in the art would appreciate that the inventive concept is not limited to the illustrated configuration.

Figure 6:
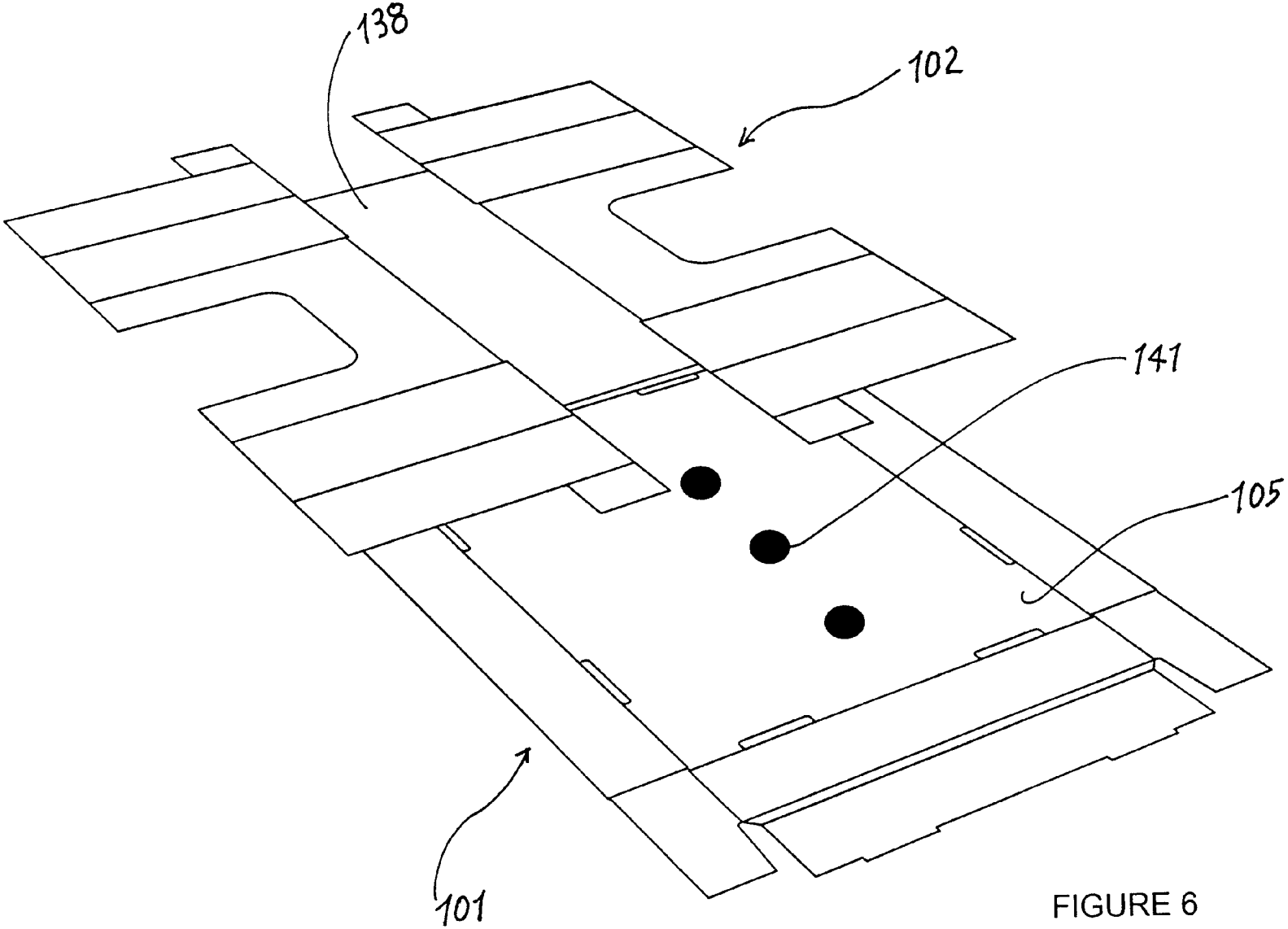
FIG. 6 shows a primary blank and a supplementary blank, according to the present disclosure, the supplementary blank being positioned over the primary blank and poised to be adhered to the primary blank via adhesive on the primary blank.
Figure 7:
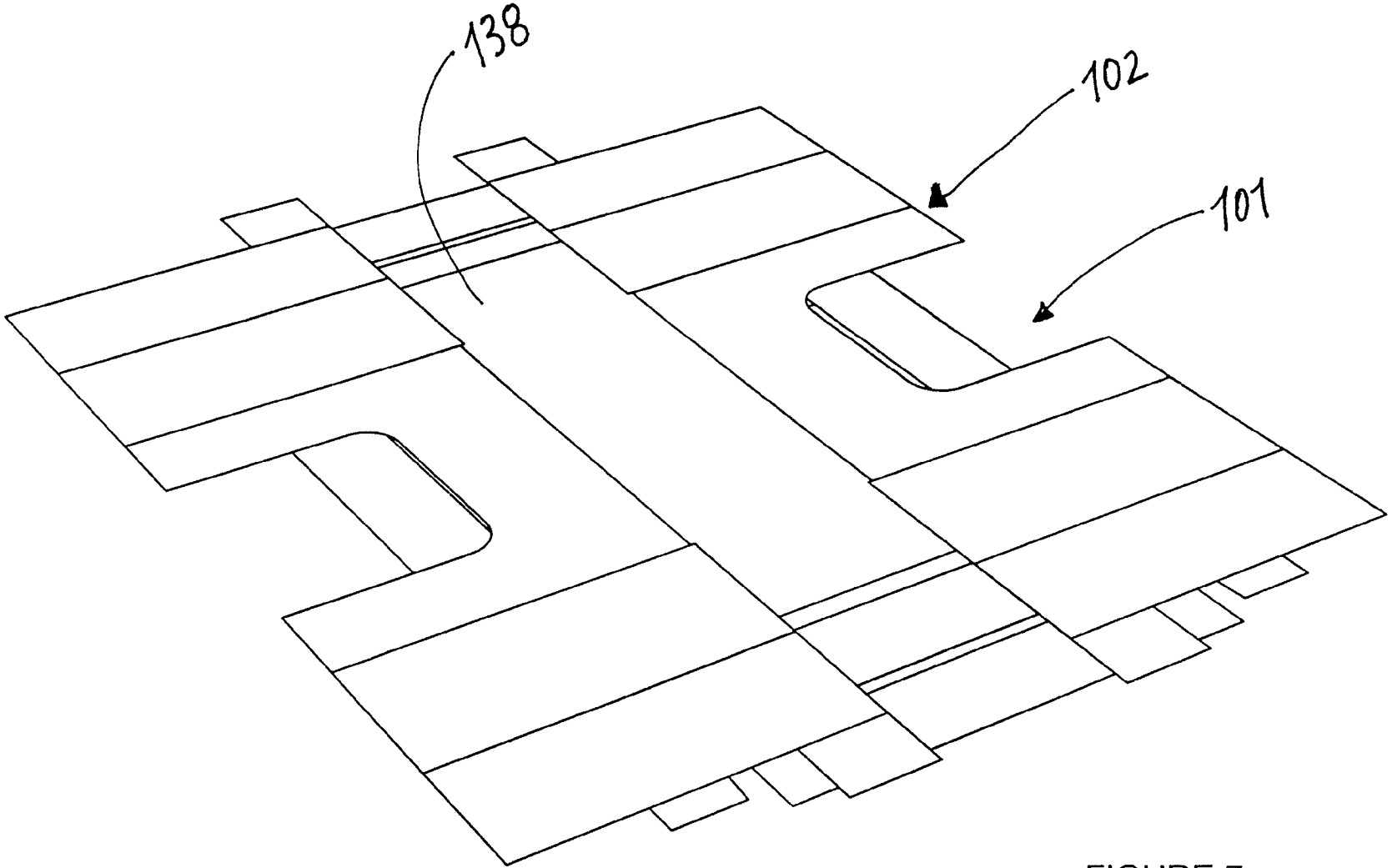
FIG. 7 shows the primary and secondary blanks of FIG. 6 adhered to one another.

In one potential implementation, one or more portions of the primary and supplementary blanks 101, 102 may be adhered to one another via, for example, adhesive such as glue, staples, tape, etc. so as to produce a preassembly (e.g., a knockdown or preassembly for the container illustrated in FIG. 1.), wherein the positioning of supplementary blank 102 in cooperation with primary blank 101 is controlled. For example, the primary and supplementary blanks 101, 102 may be adhered to each other at locations 141 with the provisioning of adhesive followed by contact between the blanks. Accordingly, adhesive may be applied on the top surface of the main or major panel 105 of the primary blank 101 (see, for example, FIGS. 4 and 6) or on a bottom surface 140 of the primary panel 138 of the supplementary blank 102. Following application of adhesive, the supplementary blank 102 may be moved in the direction 142 to provide interaction and adherence between primary and supplementary blanks 101, 102 (See FIGS. 4 and 7).

As a result of such a process, a preassembly may be provided that offers consistent positioning of the primary and secondary blank components as well as a mechanism for ensuring that the primary and secondary blanks do not become separated prior to or subsequent to final assembly of a container.

Such an implementation may have particular utility when, for example, there is a risk of containers being incorrectly assembled as a result of inaccurate positioning of the supplemental blank's primary panel (138 illustrated in FIG. 3) relative to the main panel 105 of the primary blank.

Alternatively, or in addition, it should be appreciated that a mechanism for affixing the supplementary corner tabs 122 to the corners of the tray formed by blank 101 may also be provided. For example, adhesive source 139, e.g., a sticker or other conventionally understood means for adhering materials together, may be applied to the supplementary corner tabs 122 that may include, for example, a top sheet that may be removed during final assembly to reveal a portion of adhesive that may be used to adhere the face of the corner tab 122 to the end panel 108 (or if the corner tab is inserted into the rollover slot formed by panel 108 and flap 109, to the flap 109). Alternatively, adhesive source 139 may be a dehydrated adhesive that, when moistened, becomes an effective adhesive to adhere the face of the corner tab 122 to another surface. Further, it should be appreciated that various conventionally known mechanisms may be provided for providing a connection between the corner tab 122 and components of the primary blank 101.

Returning to the manufacture of the preassembly explained above, it should be appreciated that, as a first operation in manufacturing the preassembly for the container 100, the faces of the primary and supplementary blanks 101, 102 are affixed together at various locations. Thus, although not shown, a preassembly may be provided wherein the primary and supplementary blanks 101, 102 are adhered to one another via adhesive 141 but the panels, walls, dividers, pillars and tabs are not configured for final assembly. As a result, such a preassembly may be delivered to a location for final assembly and placement of product; such a preassembly may be effectively and easily stacked with other preassemblies because such preassemblies are flat having not yet been built or assembled as shown in FIG. 1. Accordingly, it should be understood that the faces of the blanks 101, 102 may be affixed in one or more suitable manners including, for example but not limited to, application of adhesive on one or both of the affixed faces, use of staples, tape, etc.

Although FIG. 1 illustrates one example of a container that may be manufactured in accordance with illustrated embodiments, various different types of blanks and preassemblies may be used to produce various different types of containers. Thus, although one or more of the side panels may be configured in a rectangular shape, various other shapes are also suitable. Further, although illustrated in FIGS. 1-4, apertures 104 may be omitted or configured in alternative dimensions or locations between adjacent pillars.

Figure 5:
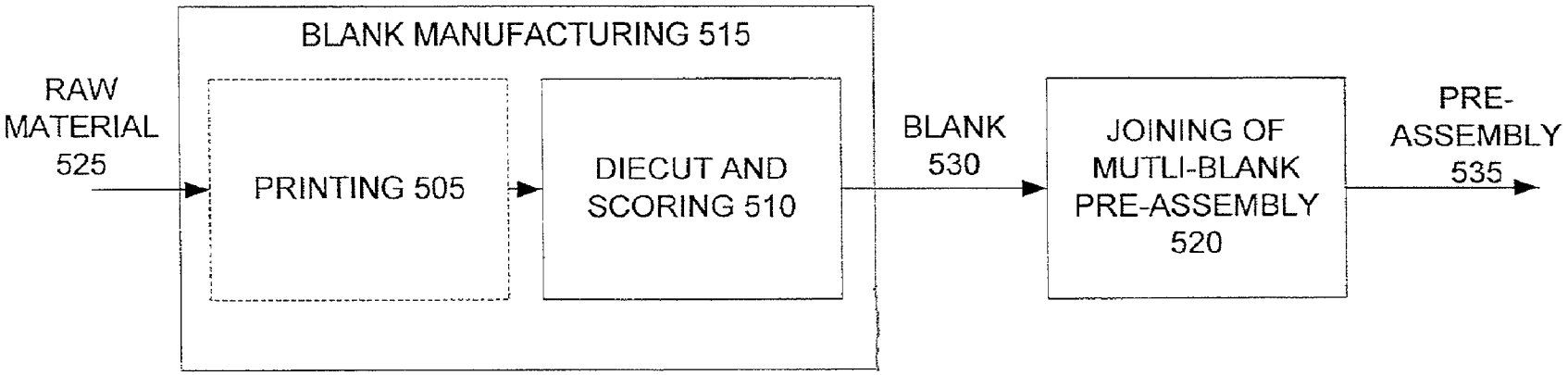
FIG. 5 illustrates a functional block diagram used to describe the manufacturing method of containers in accordance with an illustrated embodiment.

FIG. 5 illustrates a functional block diagram showing the operation of various method functions performed in accordance with a method of producing preassemblies in conjunction with illustrated embodiments. As alluded to in the background section, and as conventionally known, the manner of manufacturing containers such as the example illustrated in FIGS. 1-4 may be conveniently described in two phases: preassembly and final assembly/use.

Preassembly is normally performed at a container manufacturing facility to produce a preassembly which may also be thought of and referred to as a knockdown of the container. These preassemblies may be shipped to a customer location such as a product manufacturing facility or retail environment or third party fulfillment contract packaging facility. At that destination, the container customer may perform final assembly/use of the containers by, for example, folding and assembling various panels of the container to provide a container that is configured to hold manufacture product, e.g., for shipping and/or display.

In such operations, the manufacturing of the container preassemblies may be performed by the customer of the preassemblies and/or as part of manufacture of the preassemblies as illustrated in FIG. 5.

FIG. 5 illustrates various operations performed as part of the manufacture of a preassembly by, for example, a display, shipping or display ready packaging manufacturer. The operations may begin, for example, with printing 505 of container material prior to the container material being die cut and/or scored 510 as part of an overall blank manufacturing operation 515. The manufactured blanks 530 may or may not be printed on one or both sides of the blanks 530 depending on customer requirements. Accordingly, the printing operation 505 may be omitted.

Subsequent to blank manufacturing 515, the manufactured blanks may be affixed to one another as part of the joining of multi-blank preassembly operations 520. The operations performed at 520 may be performed in various suitable manners including by hand or using various commercially available machines (for example, those produced by Bahmueller Technologies, Inc. of Charlotte, N.C., USA or Bobst Group North America of Roseland, N.J., USA). Thus, the operations performed at 520 may produce preassemblies for containers such as that illustrated in FIG. 1.

Therefore, it should be appreciated that one or more of the operations performed to produce blanks, preassemblies, knockdowns and containers may be performed in whole or in part by machines and or human personnel. Moreover, human personnel may utilize one or more different types of machines and/or tools to perform assembly operations performed either to manufacture preassemblies or finally assembled containers.

Thus, at the beginning of such operations, raw material 525 is used to produce blanks 530. Such raw materials 525 may include but are not limited to various grades, types, configurations and combinations of corrugated fiberboard and/or solid paperboard, liner board, board of various fluting types and combinations as well as various types of sealants, non-organic materials and inks and dies of various suitable types.

It should be understood that implementation of the method and system of the present invention involves performing or completing certain selected tasks or steps manually, automatically, or a combination thereof.

While this invention has been described in conjunction with the specific embodiments outlined above, it is evident that many alternatives, modifications and variations will be apparent to those skilled in the art. Accordingly, the various embodiments of the invention, as set forth above, are intended to be illustrative, not limiting. Various changes may be made without departing from the spirit and scope of the invention.

For example, various illustrated features of the preassembly and resulting containers may be omitted. Furthermore, it should be understood that invention embodiments are capable of variations practiced or carried out in various ways. Therefore, it should be appreciated that, in accordance with at least one embodiment of the invention, any and all of the walls may be constructed of corrugated cardboard. However, it should be understood that the walls, panels, any tabs on various panels, etc., may be constructed of various industry recognized appropriate materials that meet various transporting and/or display criteria. As a result, it should be understood that containers manufactured in accordance with at least one embodiment of the invention may also be considered "cartons," which may be considered packaging or display containers, commonly made from cardstock or cardboard. Further, it should be understood that cartons come in many different varieties but most cartons can be folded and assembled from a flat form, known as a carton blank. Thus, it should be understood that the pattern for any blank, preassembly or container may be different than those described herein.

Alternatively, or more specifically, the packaging and/or display containers may be made using various types of material including, solide fibre, Solid Bleach Sulphate (SBS), currugated board, e.g., material made by a corrugator (a machine that produces corrugated board by attaching fluting to liners), which is a structured board formed by gluing one or more arched layers of corrugated medium to one or more flat-facing linerboards.

Additionally, it should be appreciated that material used in accordance with at least one embodiment of the invention may be laminated to provide barrier properties. Further, other barrier materials may be used including Ultra Violet (UV), moisture and gas barriers. Additionally, though not discussed in detail herein, it should be understood that any adhesive used to provide a bond between materials used in containers provided in accordance with the invention may include any substance that helps bond two materials together, examples including but not limited to glue and paste.

Further, it should be appreciated that the material used to form the primary blank 101 may be different, stronger, or weaker than the blank used to form the supplementary blank 102. Thus, for example, use of a supplementary blank 102 that is of a heavier, more durable or stronger material than the material used for primary blank 101, may provide the increased ease of final assembly as well as increased durability or strength to the resulting container 100 while reducing the amount of material in the container (something of interest for environmental and cost issues).

It should also be appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

Additionally, it should be understood that the functionality described in connection with various described components of various invention embodiments may be combined or separated from one another in such a way that the architecture of the invention is somewhat different than what is expressly disclosed herein. Moreover, it should be understood that, unless otherwise specified, there is no essential requirement that methodology operations be performed in the illustrated order; therefore, one of ordinary skill in the art would recognize that some operations may be performed in one or more alternative order and/or simultaneously.

As a result, it will be apparent for those skilled in the art that the illustrative embodiments described are only examples and that various modifications can be made within the scope of the invention as defined in the appended claims.

The invention claimed is:

1. A method of manufacturing a container, the method comprising:

cutting a primary blank including a major panel coupled to a plurality of side panels and end panels configured to interact during assembly of the container to provide a plurality of corners;

cutting a supplementary blank including a primary panel coupled to a plurality of pairs of first and second pillars, each pillar being coupled to a corresponding supplementary corner tab; and affixing the primary blank and the supplementary blank together, such that the primary panel is affixed to the major panel and, as the container is assembled, the supplementary blank forms the plurality of pairs of pillars that act as a mechanism for dividing the container into a plurality of compartments and as a mechanism for increasing stacking strength of the container, wherein each supplementary corner tab interacts with a corresponding corner of the plurality of corners formed by the primary blank so as to assist in maintaining a position of the plurality of pillar pairs.

2. The method of container manufacturing of claim 1, wherein the compartments are formed by the interaction of the supplementary blank with the primary blank through at least one of adhering a plurality of parts of the supplementary and primary blanks to one another.

3. The method of container manufacturing of claim 1, wherein the compartments are formed by the interaction between the supplementary corner tabs of the supplementary blank and the corners of the tray formed by the primary blank.

4. The method of container manufacturing of claim 1, wherein the interaction between each of the supplementary corner tabs and the corresponding corner of the plurality of corners formed by the primary blank includes adhering each of the supplementary corner tabs to a corresponding one of the end panels of the primary blank.

5. The method of container manufacturing of claim 1, wherein the interaction between each of the supplementary corner tabs and the corresponding corner of the plurality of corners formed by the primary blank includes inserting the supplementary corner tab into a slot formed by a corresponding one of the end panels and associated end tab of the primary blank.

6. The method of container manufacturing of claim 1, further comprising providing an adhesive source on the supplementary corner tabs, the adhesive source being arranged to provide adhesion between the supplementary corner tabs and the primary blank.

7. The method of container manufacturing of claim 6, wherein at least one of the end panel and an end flap provided on the primary blank are the components of the primary blank that interact with the supplementary corner tabs of the supplementary blank.

8. The method of container manufacturing of claim 1, wherein the primary blank and supplementary blank are affixed together via application of an adhesive.

9. A container preassembly comprising:

a primary blank including a major panel coupled to a plurality of side panels and end panels configured to interact during assembly of the container to provide a plurality of corners; and a supplementary blank including a primary panel coupled to a plurality of pairs of first and second pillars, each pillar being coupled to a corresponding supplementary corner tab, wherein the primary blank and the supplementary blank are affixed together, such that the primary panel is affixed to the major panel and, as the container is assembled, the supplementary blank forms the plurality of pairs of pillars that act as a mechanism for dividing the container into a plurality of compartments and as a mechanism for increasing stacking strength of the container, and wherein each supplementary corner tab interacts with a corresponding corner of the plurality of corners formed by the primary blank so as to assist in maintaining a position of the plurality of pillar pairs.

10. The container preassembly of claim 9, wherein the compartments are formed by the interaction of the supplementary blank with the primary blank through at least one of adhering a plurality of parts of the supplementary and primary blanks to one another.

11. The container preassembly of claim 9, wherein the compartments are formed by the interaction between the supplementary corner tabs of the supplementary blank and the corners of the tray formed by the primary blank.

12. The container preassembly of claim 9, wherein the container is a display.

13. The container preassembly of claim 9, wherein the interaction between each of the supplementary corner tabs and the corresponding corner of the plurality of corners formed by the primary blank includes adhering each of the supplementary corner tabs to a corresponding one of the end panels of the primary blank.

14. The container preassembly of claim 9, wherein the interaction between each of the supplementary corner tabs and the corresponding corner of the plurality of corners formed by the primary blank includes inserting the supplementary corner tabs into a slot formed by a corresponding one of the end panels and associated end tab of the primary blank.

15. The container preassembly of claim 9, wherein each supplementary corner tab includes an adhesive source arranged to provide adhesion between the supplementary corner tabs and the primary blank.

16. The container preassembly of claim 15, wherein at least one of the end panels and the end flap are the components of the primary blank that interact with the supplementary corner tabs of the supplementary blank.

17. The container preassembly of claim 9, wherein the primary blank is affixed to the supplementary blank via application of an adhesive.

18. A plurality of blanks for a container preassembly, the plurality of blanks comprising:

a primary blank including a major panel coupled to a plurality of side panels and end panels configured to interact during assembly of the container to provide a plurality of corners; and a supplementary blank including a primary panel coupled to a plurality of pairs of first and second pillars, each pillar being coupled to a corresponding supplementary corner tab, wherein the primary blank and secondary blank are configured to be affixed together, such that the primary panel is affixed to the major panel and, as the container is assembled, the supplementary blank forms the plurality of pairs of pillars that act as a mechanism for dividing the container into a plurality of compartments and as a mechanism for increasing stacking strength of the container, and wherein each supplementary corner tab interacts with a corresponding corner of the plurality of corners formed by the primary blank so as to assist in maintaining a position of the plurality of pillar pairs.

19. The plurality of blanks of claim 18, wherein the compartments are formed by the interaction of the supplementary blank with the primary blank through at least one of adhering a plurality of parts of the supplementary and primary blanks to one another.

20. The plurality of blanks of claim 18, wherein the compartments are formed by the interaction between the supplementary corner tabs of the supplementary blank and the corners of the tray formed by the primary blank.

21. The plurality of blanks of claim 18, wherein the interaction between each of the supplementary corner tabs and the corresponding corner of the plurality of corners formed by the primary blank includes adhering each of the supplementary corner tabs to a corresponding one of the end panels of the primary blank.

22. The plurality of blanks of claim 18, wherein the interaction between each of the supplementary corner tabs and the corresponding corner of the plurality of corners formed by the primary blank includes inserting the supplementary corner tabs into a slot formed by a corresponding one of the end panels and associated end tab of the primary blank.

23. The plurality of blanks of claim 18, wherein each supplementary corner tab includes an adhesive source arranged to provide adhesion between the supplementary corner tab and the primary blank.

24. The plurality of blanks of claim 23, wherein at least one of the end panels and an end flap of the primary blank are the components of the primary blank that interact with the supplementary corner tabs of the supplementary blank.

25. The plurality of blanks of claim 18, wherein the primary blank is affixed to the supplementary blank via application of an adhesive.

* * * * *